United States Patent [19]

Ragan

[11] 4,225,845

[45] Sep. 30, 1980

[54] OPEN FRAME SINGLE TURN POTENTIOMETER WITH HELICAL COIL SPRING WIPER AND RESILIENT MEMBER

[75] Inventor: Randall C. Ragan, Rancho Sante Fe, Calif.

[73] Assignee: North American Philips Corporation, New York, N.Y.

[21] Appl. No.: 938,715

[22] Filed: Aug. 30, 1978

Related U.S. Application Data

[63] Continuation-in-part of Ser. No. 723,932, Sep. 16, 1976, Pat. No. 4,121,188, which is a continuation of Ser. No. 642,328, Dec. 19, 1975, abandoned, which is a continuation-in-part of Ser. No. 452,130, Mar. 18, 1974, Pat. No. 3,964,011.

[51] Int. Cl.[2] ..... H01C 10/34

[52] U.S. Cl. ..... 338/174; 338/163; 338/202

[58] Field of Search ..... 338/174, 163, 164, 184, 338/188, 171, 202

[56] References Cited

U.S. PATENT DOCUMENTS

| | | | |
|---|---|---|---|
| 2,418,472 | 4/1947 | Kline | 338/163 X |
| 2,451,241 | 10/1948 | Rosentreter | 338/163 X |
| 2,576,044 | 11/1951 | Richman et al. | 338/184 X |
| 2,909,749 | 10/1959 | Barden et al. | 338/163 |
| 3,119,089 | 1/1964 | Murry | 338/174 |
| 3,531,753 | 9/1970 | Geese | 338/174 X |
| 3,961,302 | 6/1976 | Hufford | 338/163 X |
| 3,964,011 | 6/1976 | Ragan | 338/166 |
| 4,110,722 | 8/1978 | Brendle et al. | 338/184 X |
| 4,121,188 | 10/1978 | Ragan | 338/174 |

*Primary Examiner*—C. L. Albritton

*Attorney, Agent, or Firm*—Thomas A. Briody; Jack Oisher; James J. Cannon, Jr.

[57] ABSTRACT

An open frame single turn potentiometer with a helical coil spring wiper including a resilient member situated between the substrate and the rotor. The resilient member consists of an annular ring preferably having a "D-shaped" or hemispherically shaped cross section. This "D" ring member performs the function of providing a spring action between the substrate and the rotor; means for controlling torque; and means for adjusting to the build-up in tolerences between the various component elements of the trimmer, thereby achieving optimum electrical and mechanical performance.

4 Claims, 6 Drawing Figures

OPEN FRAME SINGLE TURN POTENTIOMETER WITH HELICAL COIL SPRING WIPER AND RESILIENT MEMBER

REFERENCE TO RELATED APPLICATIONS

This application is a continuation-in-part of copending U.S. application Ser. No. 723,932, filed Sept. 16, 1976 now U.S. Pat. No. 4,121,188, which is a continuation of U.S. application Ser. No. 642,328, filed Dec. 19, 1975, now abandoned, which in turn is a continuation-in-part of application Ser. No. 452,130, filed Mar. 18, 1974, now U.S. Pat. No. 3,964,011.

BACKGROUND OF THE INVENTION

This invention relates to miniaturized electronic components, and particularly to variable resistor devices.

Variable resistor devices such as trimmer potentiometers are well known in the art. Although it has been known to utilize a helical spring wiper in the rotor assembly portion of a trimmer potentiometer, such previously known designs were disadvantageous in many respects. The most significant of these problems include the contact resistance variation (CRV), poor torque control, and the build-up of tolerances of the various component elements of the trimmer potentiometer. Further background information on miniaturized potentiometers including helical spring wipers is presented in the parent application, U.S. Pat. No. 3,964,011, which is hereby incorporated by reference.

SUMMARY OF THE INVENTION

It is an object of the invention to provide an open frame electronic component having rotor and substrate, and including resilient means disposed between the rotor and the substrate.

It is another object of the invention to provide a miniature single turn potentiometer including a rotor, a substrate containing a resistance element, a coil spring wiper contact including a solid cylindrical backing pad, and a resilient member disposed between the substrate and rotor assemblies.

It is yet another object of the invention to provide means in a miniaturized electronic component for controlling torque, for providing a spring action between the rotor and substrate, for providing improved mechanical stability, for adjusting to the build-up in tolerances between component elements, and for providing improved electrical stability, settability and adjustability.

The present invention generally provides a single turn variable resistance device including a ceramic substrate having an opening therein, a collector ring and an arcuate resistance element surrounding the opening; a rotor having a first portion engaging the opening in the substrate as a bearing surface, and second portion including a multi-contact wiper facing the substrate for making electrical contact between the collector ring and the resistance element; and means for resiliently biasing the substrate against the rotor.

More particularly, the present invention provides a variable resistance device comprising a substrate having an opening therein, the substrate having a first side including a central collector ring and an arcuate resistance element, and a second side opposite the first side; terminal means on the substrate in connection to at least one end of the resistance element and the collector; a rotor having a first portion facing the second side of the substrate, a second portion adjacent the first portion and journalled for rotation in the opening in the substrate, and a third portion facing the first side of the substrate and including a recess therein facing the resistance element and the collector ring; a multicontact wiper in the recess and engaging the resistance element and the collector ring for making electrical contact therebetween; a resilient support located in the recess and pressed against an arcuate portion of the wiper for constraining the wiper from axial rotation as the rotor is moved; and resilient means engaging the first portion of the rotor and acting as a bearing surface, and circumferentially surrounding the opening on the second side of the substrate for biasing the substrate against the rotor.

The novel features which are considered as characteristic for the invention are set forth in particular in the appended claims. The invention itself, however, both as to its construction and its method of operation, together with additional objects and advantages thereof will be best understood from the following description of specific embodiments when read in connection with the accompanying drawings.

BRIEF DESCRIPTION OF THE DRAWINGS

The same reference numerals in the different Figures of the drawing refer to like elements.

DESCRIPTION OF THE PREFERRED EMBODIMENTS

Figure 1:
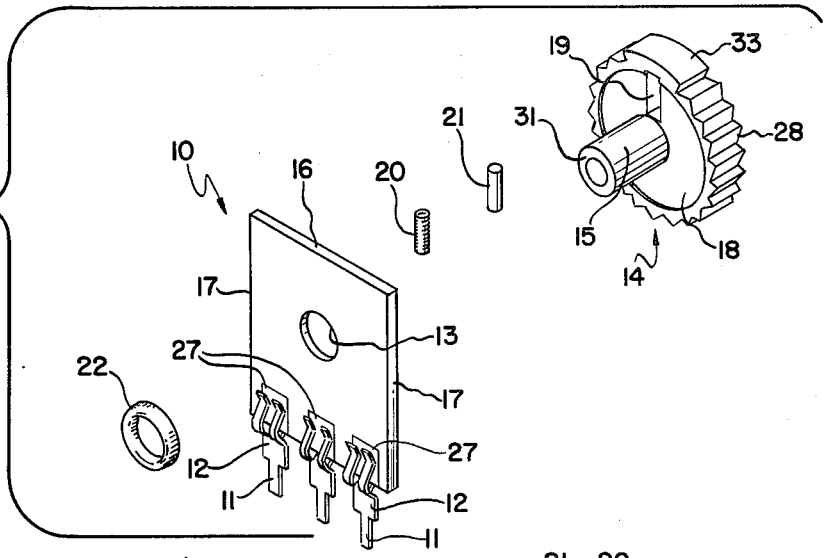
FIG. 1 is an exploded view of the trimming potentiometer according to the present invention.

FIG. 1 is an exploded view of the open-frame single turn trimming potentiometer according to the present invention. The invention provides a generally rectangular substrate 10, having a shorter edge 16 and a longer edge 17, composed of a ceramic material such as 96% aluminum oxide ($Al_2O_3$). The first side of the substrate (not shown in FIG. 1) supports a central collector ring and an arcuate resistance element, which will be discussed subsequently with reference to FIG. 2. The second side of the substrate, shown in FIG. 1, supports three rectangular terminal pads 27 which are composed of a conductive material screen-printed on the substrate 10. The terminal pads 27 on the second side of the substrate 10 perform the mechanical function of enabling secure engagement by the three terminal means 12. The three terminal means 12 include three corresponding terminal leads 11 which function to make electrical connection from the circuit on the substrate to an external circuit. In a first embodiment, shown in FIG. 1, the terminal means 12 consist of clips which clip on the substrate and make electrical contact with the terminal pads 27, in which case the terminal means 12 may be referred to as "clip leads". Leads are then dip soldered to provide additional strength and conductivity. In a second embodiment (not shown) the leads 11 may be swaged or soldered directly to terminal pads 27.

It should also be understood that the lead attachment method and configuration described above is applicable to many other types of substrate elements such as resistor network packages and dual-in-line packages. The essence of this lead attachment technique is that good mechanical connections are made between conductor and substrate and unsoldering of leads is prevented when the package is soldered into a circuit board. The substrate 10 also includes a circular opening 13, preferably equidistant between the two longer edges 17 of the substrate 10.

The rotor 14 is generally cylindrically shaped and composed of a synthetic plastic material, such as a thermoplastic polyester or nylon. The rotor 14 has a diameter slightly larger than the length of the shorter edge 16 of the substrate 10. The unassembled rotor 14 includes a hollow cylindrical first portion 31, an adjacent hollow cylindrical second portion or stem 15 with the same diameter as the first portion, and a substantially solid cylindrical third portion with a larger diameter having a major surface 18 facing the first and second portions. The second portion or stem 15 is located in the center of the rotor 14 and extends normal to the major surface 18 of the third portion of the rotor. The stem 15 has a diameter slightly less than the diameter of the opening 13 in the substrate 10, so that when the rotor and substrate are assembled to form the potentiometer, the stem 15 will extend through the opening 13 and rotate therein as a bearing surface. The major surface 18 faces the first side of the substrate 10 and the first portion 31 faces the second side of the substrate 10 after the potentiometer is assembled.

The circumferential edge of the third portion of the rotor 14 includes a knurled portion 28 and a protrusion or shoulder 33. The knurled portion 28 enables the rotor to be turned by finger, and the shoulder 33 is designed, upon rotation of the rotor 14, to engage a portion of the lead of the center one of the three terminal means 12 for preventing the rotor from exceeding a predetermined degree of travel along the substrate. Such portion of the conductor lead of the center one of the terminal means 12, or the corresponding portion of the conductor lead in the second embodiment (not shown), protrudes above the surface of the first side of the substrate 10, and acts as a stop for preventing the rotor from further rotation in the same direction when the shoulder 33 engages the protruding portion.

The third portion and major surface 18 of the rotor 14 is furthermore provided with a rectangular cavity 19 which is disposed radially with respect to the stem 15 of the rotor 14, and spaced apart from the center of rotation of the rotor. A multicontact helical coil spring wiper 20 and a cylindrically shaped backing pad or resilient support 21 are provided which are placed into the cavity 19. An arcuate portion of the helical coil spring wiper 20 extends above the major surface 18 of the rotor 14 and makes contact with the central collector ring and the arcuate resistance element on the substrate 10 when the potentiometer is assembled.

The coil spring wiper 20 is designed so that there is a maximum number of turns in the linear dimension of the wiper to provide optimum contact with the resistance element. The size of the wire is chosen for resiliency and strength as well as to get the maximum number of turns per linear dimension. Thus, if the wire is too large in diameter, an insufficient number of turns is produced; if it is too small, the coil spring wiper will collapse or bend under the continued pressure of the rotor against the substrate. The coil spring is constructed of any metal that has good electrical conductivity, is non-corrosive, and is capable of being hardened into a spring-like consistency. A preferred form is "Paliney 6" which is proprietary composition of the Ney Company. Nickel silver (a nickel-zinc alloy) or copper alloys may be used as well. The preferred diameter of the coil spring wire is from 2 to 5 mils. The coil dimensions for use in a ⅜-inch size potentiometer are approximately 0.032 inches in diameter, and 0.080 inches in length.

The resilient support 21 for the coil spring wiper is preferably a solid cylindrical member composed of silicone rubber having a predetermined hardness sufficient to compress on contact. The length and diameter of the support 21 are substantially the same as that of the helical coil spring wiper 20.

The D-ring member 22 is an annular ring which circumferentially surrounds the opening 13 on the second major side of the substrate 10. The D-ring member 22 is preferably made of an elastomeric synthetic plastic material, such as silicone rubber. The D-ring member 22 engages the stem 15 of the rotor 14 as it emerges from the opening 13, and acts both as a bearing surface for the rotation of the stem 15, as well as a resilient spring for biasing the rotor against the substrate in a controllable manner. The member 22 may also act as a seal for sealing the opening 13 and thereby the interior of the potentiometer from the external environment.

The D-ring member 22 is typically hemispherical or "D-shaped" in cross section, with a flat first edge and a round second edge. The flat edge of the member 22 is placed against and engages the second side of the substrate 10, while the round edge engages the deformed first portion 31 of the rotor after assembly. An "O"-ring member may be used in place of the D-ring although the "D" ring is preferred for better stability.

Figure 2:
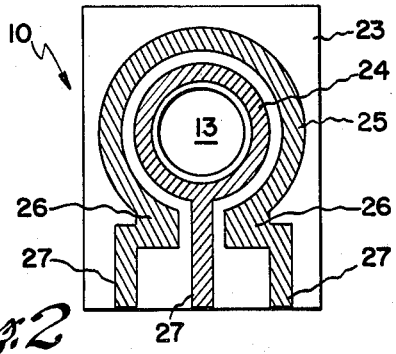
FIG. 2 is a top plan view of the substrate of the potentiometer according to the present invention showing a collector ring and arcuate resistance element.

FIG. 2 illustrates the plan view of the first side of the substrate 10 incorporating the central collector ring 24, arcuate resistance element 25, and opening 13 according to the present invention. The collector and resistance element need not necessarily be on the same side of the substrate although such a modified configuration would require modification of the wiper structure.

The substrate 10 comprises a ceramic base 23 upon which the central collector ring 24, the resistance element 25, metal interconnection paths 26, and terminal pads 27 are imprinted by standard cermet and metallizing technology. The collector ring 24 is a thin, highly conductive ring surrounding the opening 13 in the substrate 10. The collector ring 24 is typically composed of silver, silver palladium, or gold platinum. The arcuate resistance element 25 is configured as a loop portion which circumferentially surrounds a portion of the collector ring 24. The two opposed ends of the loop portion of the arcuate resistance element 25 make electrical contact with the two interconnection paths 26 which electrically connect the respective two ends of the arcuate resistance element 25 with two terminal pads 27 located at the edge of the substrate 10. A similar interconnection track 26 connects the central collector ring 24 with the central terminal pad 27 for the collector ring.

Figure 3:
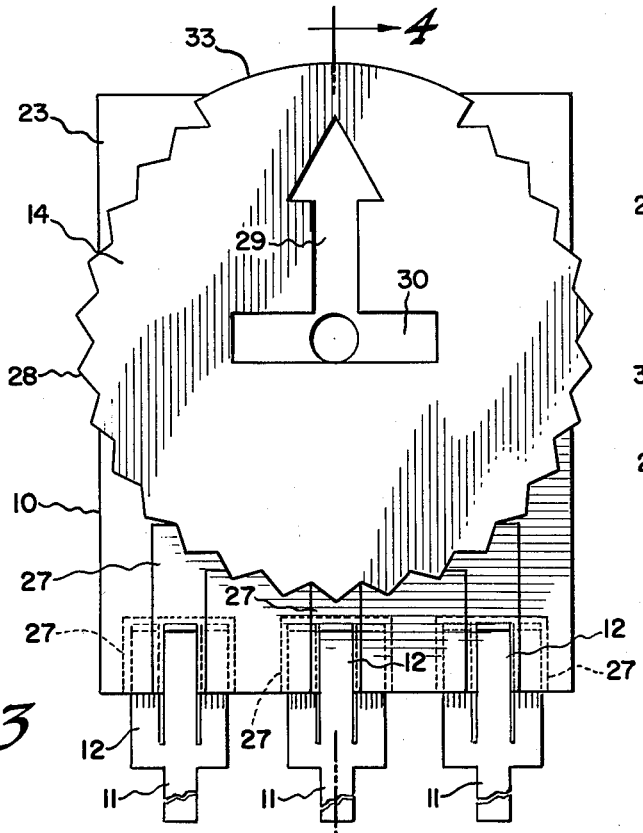
FIG. 3 is a top plan view of the trimming potentiometer incorporating a "D" ring member as taught by the present invention.

FIG. 3 is a top plan view of the trimming potentiometer with the rotor assembled on the substrate. The rotor 14 is preferably a molded, one piece thermoplastic unit which has knurled or reeded side portion 28 and a shoulder 33. The top surface of the rotor 14 contains two cavities 29 and 30 which are adapted for receiving an adjustment tool, such as a screwdriver. The user uses the screwdriver to rotate the rotor with respect to the fixed substrate 10. The terminal means 12 shown in FIG. 3 are those of the first embodiment described with reference to FIG. 1, that is, clip-leads. The clip-leads are seen to include a clip portion which clips over the terminal pads 27 on the surface of the substrate 10 and makes mechanical and electrical engagement with such terminal pads by means of a spring action. The clip-leads are subsequently dip-soldered or reflow soldered to provide electrical or mechanical reinforcement.

Figure 4:
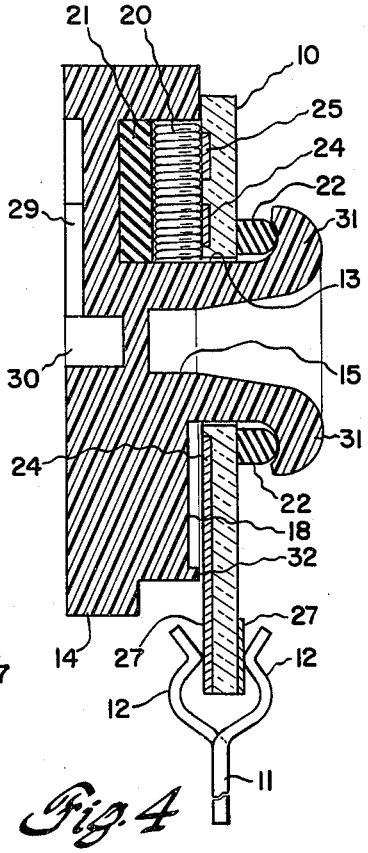
FIG. 4 is a cross-sectional view through the 4—4 plane of FIG. 3 with the rotor inserted in the substrate.

FIG. 4 is a cross sectional view of the trimming potentiometer through the 4—4 plane of the embodiment shown in FIG. 3. The cross sectional view of FIG. 4 more particularly shows the hollow stem 15 of the rotor 14 which extends through the opening 13 in the substrate 10 after assembly of the potentiometer. The stem 15 is journalled to rotate in the opening 13. During assembly of the potentiometer, the hollow end portion of the stem 15 is inserted into the opening 13 of the substrate 10 so that the first portion 31 of the rotor 14 extends beyond the D-ring member 22. The first portion 31 is then deformed by being riveted or pressed outward so as to engage the D-ring 22, thereby securing the rotor 14 to the substrate 10.

The D-ring member 22 thereby performs the function of providing a spring action between the substrate and the rotor so as to tightly seal the aperture 13, yet enable the rotor 14 to rotate within such opening. Moreover, as pointed out above, the D-ring member 22 provides a means for controlling the torque of the device as a function of the changing external parameters (pressure, heat and time). The D-ring thereby enables the trimmer potentiometer according to the present invention to achieve optimum electrical and mechanical performance.

FIG. 4 also shows the cavity 19 (labelled in FIG. 1) in the rotor 14 with the cylindrical backing pad 21 and the helical coil spring wiper 20 inserted therein. The cavity 19 is constructed to a predetermined depth in the rotor 14 sufficient to receive the cylindrical resilient support 21 together with the helical coil spring wiper 20. The depth of the cavity 19 is chosen so that the resilient support 21 is only moderately compressed, while the helical coil spring wiper 20 protrudes sufficiently above the major plane surface 18 of the rotor 14 so as to make contact between the central collector ring 24 and the resistive element 25 after assembly.

Under compression, the cylindrical resilient support 21 will deform into a new shape to conform with the geometry of the cavity and the adjacent arcuate portion of the coil spring wiper 20, thereby providing better engagement with the coil spring wiper 20. The resilient support 21 presses against the arcuate portion of the coil spring wiper 20 and constrains the wiper from axial rotation as the rotor is moved. The wiper therefor slides over the collector ring 24 and resistance element 25, as the rotor is turned, and does not twist or roll, thereby providing improved CRV in the device.

FIG. 4 also shows a cross-section of the rim 32 which is located at the periphery of the major surface 18 of rotor 14. The rim 32 engages the substrate 10 as a bearing surface, and provides stability to the rotor as it is turned. The rim 32 furthermore acts as a dust seal and prevents wear on the surface of the rotor after prolonged use of the device.

Figure 5:
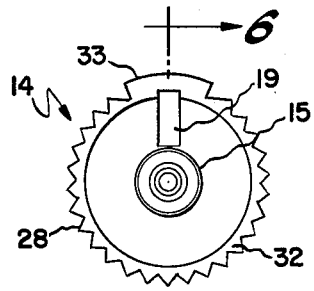
FIG. 5 is a plan view of the bottom side of the rotor without the helical coil spring wiper in place.

FIG. 5 is a plan view of the major surface 18 of the rotor 14 prior to assembly of the potentiometer. The positioning of the cavity 19 as being radially disposed with respect to the stem 15 is shown. FIG. 5 moreover shows the circumferential rim 32 extending entirely around the circumferential edge of the rotor 14, and the location of the shoulder 33.

Figure 6:
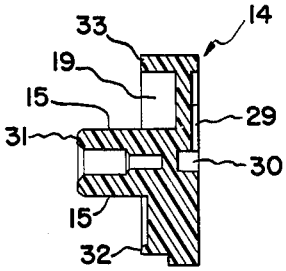
FIG. 6 is a cross-sectional view of the rotor through the 6—6 plane shown in FIG. 5 prior to insertion of the rotor into the substrate and assembly of the potentiometer.

FIG. 6 is a cross sectional view of the rotor 14 in FIG. 5 through the 6—6 plane. The rim 32, the shoulder 33, and the cavity 19 as shown in relation to the cross-section of the unassembled rotor in greater detail. The first portion 31 of the rotor 14, and the second portion or stem 15 of the rotor are also shown prior to assembly. After insertion of the rotor 14 in the substrate 10, a riveting tool bends the first portion 31 outward to engage the D-ring member 22, and the end portion 31 assumes a shape shown in FIG. 4.

Further description of the general operation of trimmer potentiometers are disclosed in the parent applications and reference is made thereto for further information.

While the invention has been illustrated and described as embodied in an Open Frame Single Turn Potentiometer with Helical Coil Spring Wiper and Resilient Member, it is not intended to be limited to the details shown, since various modifications and structural changes may be made by those skilled in the art without departing in any way from the spirit of the present invention.

I claim:

1. A variable resistance device comprising:

a substantially flat substrate having first and second opposed major surfaces and an opening therein and on the first surface a central collector ring and an arcuate resistance element;

terminal means on said substrate and connected to at least one end of said resistance element and to said collector;

conductor leads affixed to said terminal means, at least one conductor lead having a portion protruding above the first surface of said substrate;

a rotor having a main body portion located adjacent the substrate first surface and a projecting stem portion extending through the substrate opening and together forming a first annular rotor portion extending over and facing said second surface of said substrate, a second rotor portion adjacent said first portion and journalled for rotation in said opening in said substrate, and a third rotor portion facing said first surface of said substrate and including a recess therein facing said resistance element and said collector ring;

a multicontact wiper disposed in said recess and engaging said resistance element and said collector ring and making electrical contact therebetween;

a resilient support located in said recess behind said wiper and bearing against an arcuate portion of said wiper and constraining said wiper from rotating within its recess when said rotor is moved; and resilient means circumferentially surrounding said opening and said rotor stem portion and located on said second surface of said substrate under and engaging said first annular rotor portion as a bearing surface and biasing said thrid rotor portion against said first substrate surface, said resilient means and first rotor portion serving to rotatably secure said rotor to said substrate.

2. A device as defined in claim 1 wherein said third portion of said rotor includes a shoulder which interferes with the portion of said conductor lead protruding above the first surface of said substrate as said rotor is rotated and prevents said rotor from exceeding a predetermined degree of travel with respect to said substrate.

3. A variable resistance device comprising:

a substantially flat substrate having first and second opposed major surfaces and an opening therein and on the first surface a central collector ring and an arcuate resistance element;

terminal means on said substrate and connected to at least one end of said resistance element and to said collector;

a rotor having a main body portion located adjacent the substrate first surface and a projecting stem portion extending through the substrate opening and together forming a first annular rotor portion extending over and facing said second surface of said substrate, a second rotor portion adjacent said first portion and journalled for rotation in said opening in said substrate, and a third rotor portion facing said first surface of said substrate and including a recess therein facing said resistance element and said collector ring;

a multicontact wiper disposed in said recess and engaging said resistance element and said collector ring and making electrical contact therebetween;

a resilient support located in said recess behind said wiper and bearing against an arcuate portion of said wiper and constraining said wiper from rotating within its recess when said rotor is moved;

resilient means circumferentially surrounding said opening and said rotor stem portion and located on said second surface of said substrate under and engaging said first annular rotor portion as a bearing surface and biasing said third rotor portion against said first substrate surface, said resilient means and first rotor portion serving to rotatably secure said rotor to said substrate; and said resilient means comprising an annular ring of elastomeric synthetic plastic material.

4. A device as defined in claim 3, wherein said annular ring has a D-shaped cross-section and includes a flat first edge and a round second edge, said first edge engaging said second surface of said substrate, said second edge engaging said first portion of said rotor.

* * * * *